US006826933B2

(12) United States Patent
Merkle et al.

(10) Patent No.: US 6,826,933 B2
(45) Date of Patent: Dec. 7, 2004

(54) DUAL USE DETERGENT DISPENSER

(75) Inventors: Scott A. Merkle, Newton, IA (US); Jeffrey A. Shown, Marlboro, MA (US); Jason D. Berube, Methuen, MA (US); Boyd D. Boucher, Dorchester, MA (US); Shaun T. Kjellman, Nashua, NH (US); Clifford S. Lansil, Toronto (CA); Torben C. Thurow, Boston, MA (US); Michael E. Morris, Arlington, MA (US)

(73) Assignee: Maytag Corporation, Newton, IA (US)

( * ) Notice: Subject to any disclaimer, the term of this patent is extended or adjusted under 35 U.S.C. 154(b) by 129 days.

(21) Appl. No.: 10/068,406

(22) Filed: Feb. 6, 2002

(65) Prior Publication Data

US 2003/0145633 A1 Aug. 7, 2003

(51) Int. Cl.[7] ..... D06F 39/08
(52) U.S. Cl. ..... 68/17 R; 68/12.18; 68/207
(58) Field of Search ..... 68/12.18, 13 R, 68/17 R, 207; 222/651, 129, 134, 173, 189, 204, 416; 134/94.1, 95.1, 100.1, 93

(56) References Cited

U.S. PATENT DOCUMENTS

| | | | | | |
|---|---|---|---|---|---|
| 2,288,791 | A | * | 7/1942 | Culliton | 422/119 |
| RE24,198 | E | * | 8/1956 | Sharp et al. | 134/56 D |
| 2,993,357 | A | * | 7/1961 | Smith et al. | 68/207 |
| 3,019,629 | A | * | 2/1962 | Ross | |
| 3,035,431 | A | * | 5/1962 | Smith et al. | |
| 3,086,379 | A | * | 4/1963 | Plante | |
| 3,827,600 | A | * | 8/1974 | Janke | |
| 4,160,367 | A | * | 7/1979 | Vona, Jr. | |
| 4,264,100 | A | * | 4/1981 | Keeler, II | 296/97.8 |
| 4,417,457 | A | * | 11/1983 | Brenner | 68/17 A |
| 4,687,121 | A | * | 8/1987 | Copeland, James L. | 222/64 |
| 4,700,554 | A | * | 10/1987 | Eichman et al. | 68/17 R |
| 4,727,733 | A | * | 3/1988 | Huber | |
| 4,759,202 | A | * | 7/1988 | Caron | 68/17 R |
| 4,960,139 | A | | 10/1990 | Rizzetto | |
| 5,031,649 | A | * | 7/1991 | Marks et al. | |
| 5,167,350 | A | * | 12/1992 | Amberg et al. | |
| 5,261,432 | A | * | 11/1993 | Sandrin | 134/93 |
| 5,613,379 | A | | 3/1997 | Kim | |
| 5,746,353 | A | * | 5/1998 | Cheok et al. | |
| 5,870,906 | A | * | 2/1999 | Denisar | 68/17 R |
| 5,934,109 | A | * | 8/1999 | Kiefer et al. | |
| 6,189,551 | B1 | * | 2/2001 | Sargeant et al. | 134/200 |
| 6,227,012 | B1 | * | 5/2001 | Borroni et al. | |

FOREIGN PATENT DOCUMENTS

| | | | |
|---|---|---|---|
| DE | 003215501 A1 | | 11/1983 |
| FR | 2202182 | * | 5/1974 |
| FR | 2593697 | * | 8/1987 |
| GB | 2187764 A | | 9/1987 |

OTHER PUBLICATIONS

European Patent Office 628,651 Dec. 1994, Dino.*
European Patent Office 628,651 Dec. 1994.*

* cited by examiner

*Primary Examiner*—Frankie L. Stinson
(74) *Attorney, Agent, or Firm*—McKee, Voorhees & Sease, P.L.C.

(57) ABSTRACT

A clothes washing machine is provided with an improved detergent dispenser which can use either liquid or powder detergent for both the prewash and wash cycles of the machine. The dispenser includes a base for receiving the prewash detergent. A tray having a powder detergent cup and a fabric softener cup is positioned within the base. A liquid detergent cup is removably nested within the powder detergent cup. The liquid detergent cup includes a siphon which drains into the powder detergent cup, which in turn drains into the base of the dispenser. The softener cup includes a siphon which drains into the base of the dispenser. The base includes an outlet drain through which the detergent and fabric softener drain for introduction into the tub of the washing machine.

28 Claims, 5 Drawing Sheets

DUAL USE DETERGENT DISPENSER

BACKGROUND OF THE INVENTION

Clothes washing machines typically have a detergent dispenser to receive either a powder or a liquid detergent which is added to the tub during a wash cycle of the machine. Some washing machines include compartments for laundry conditioners, such as fabric softener or bleach, as well as a compartment for detergent to be used in a prewash cycle. The prewash cycle is typically followed by a main wash cycle which includes a second dose of detergent from the dispenser. The dispenser configuration for a powder detergent is different than the configuration for a liquid detergent. For example, powder detergents typically do not require walls in the dispenser, which are required to contain liquid detergents. Also, liquid detergents generally work well with a siphon system, whereas powder detergents do not work well with a siphon system. Thus, the specific dispenser or compartment configuration provided in the washing machine normally dictates the type of detergent that can be used.

Accordingly, a primary objective of the present invention is the provision of an improved detergent dispenser for a clothes washing machine which can handle either powder or liquid detergent for both the prewash and main wash cycles.

Another objective of the present invention is the provision of an improved detergent dispenser for a washing machine which allows the user to select the configuration, and thus the type of detergent, that can be used for the wash cycle of the machine.

Still another objective of the present invention is the provision an improved detergent dispenser for a washing machine that can be changed by the user in order to function as either a powder detergent dispenser or a liquid detergent dispenser.

Yet another objective of the present invention is the provision of a detergent dispenser having dual cups for powder and liquid detergent, with one cup being removably mounted in the other cup.

Another objective of the present invention is the provision of a washing machine detergent dispenser having a single drain opening for prewash detergent, main wash detergent, and fabric conditioner.

These and other objectives will become apparent from the following description of the invention.

BRIEF SUMMARY OF THE INVENTION

An improved detergent dispenser is provided for a clothes washing machine. The machine has a tub for holding clothes to be washed, and may be a front loading or top loading machine. The detergent dispenser includes a base mounted in the washing machine. A first powder detergent cup is mounted in the base to hold and dispense a powder detergent into the tub during the main wash cycle. A second liquid detergent cup is removably mounted in the first cup to hold and dispense a liquid detergent into the tub during the main wash cycle. The dispenser is provided with an area to receive either liquid or powder detergent for a prewash cycle. A third cup is provided for holding and dispensing fabric softener into the tub. The dispenser includes a single drain opening through which the prewash detergent, main wash detergent, and fabric softener pass at the appropriate time of the wash cycle.

DETAILED DESCRIPTION OF THE INVENTION

Figure 3:
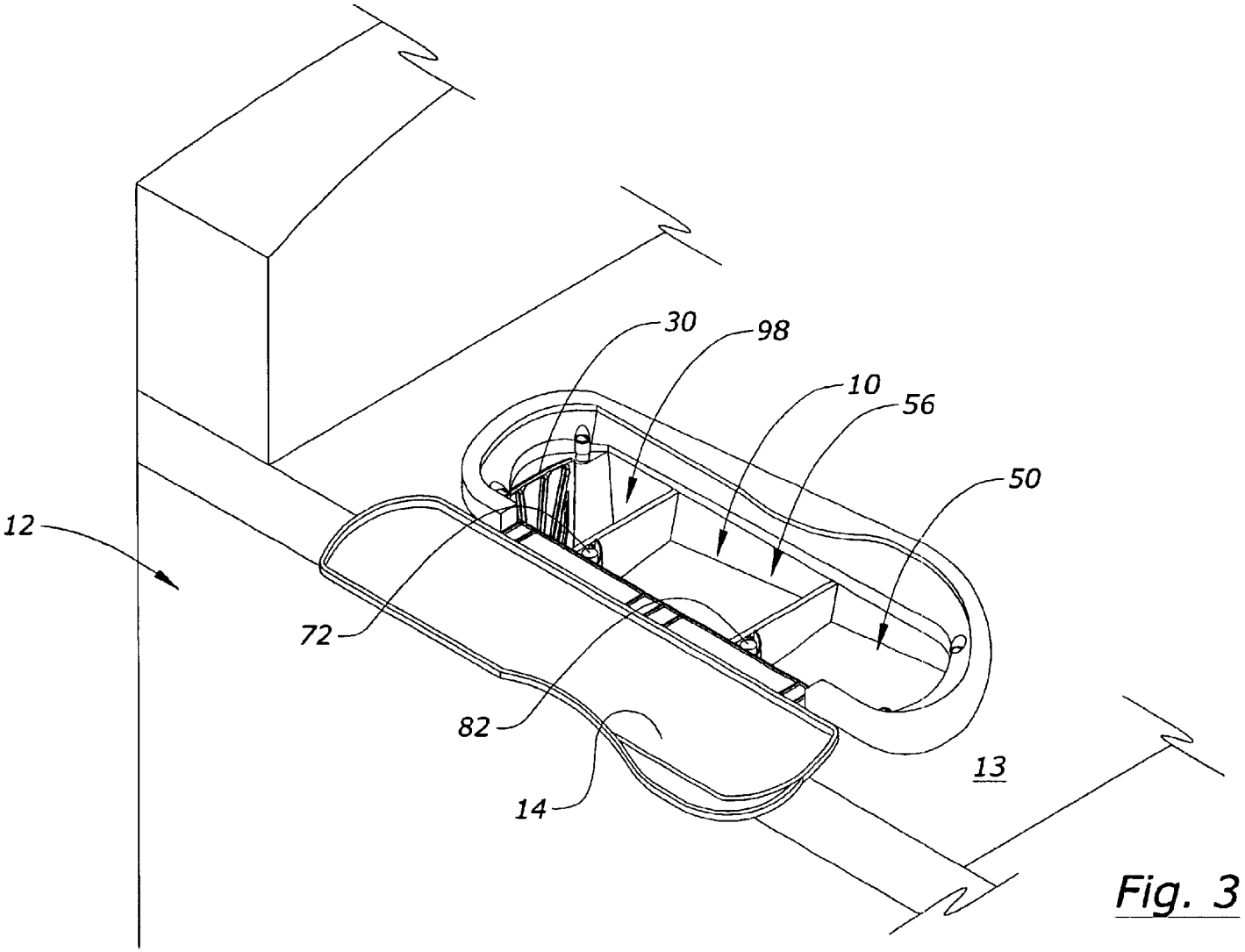
FIG. 3 is a perspective view showing the improved detergent dispenser of the present invention mounted in a front loading washing machine.
Figure 4:
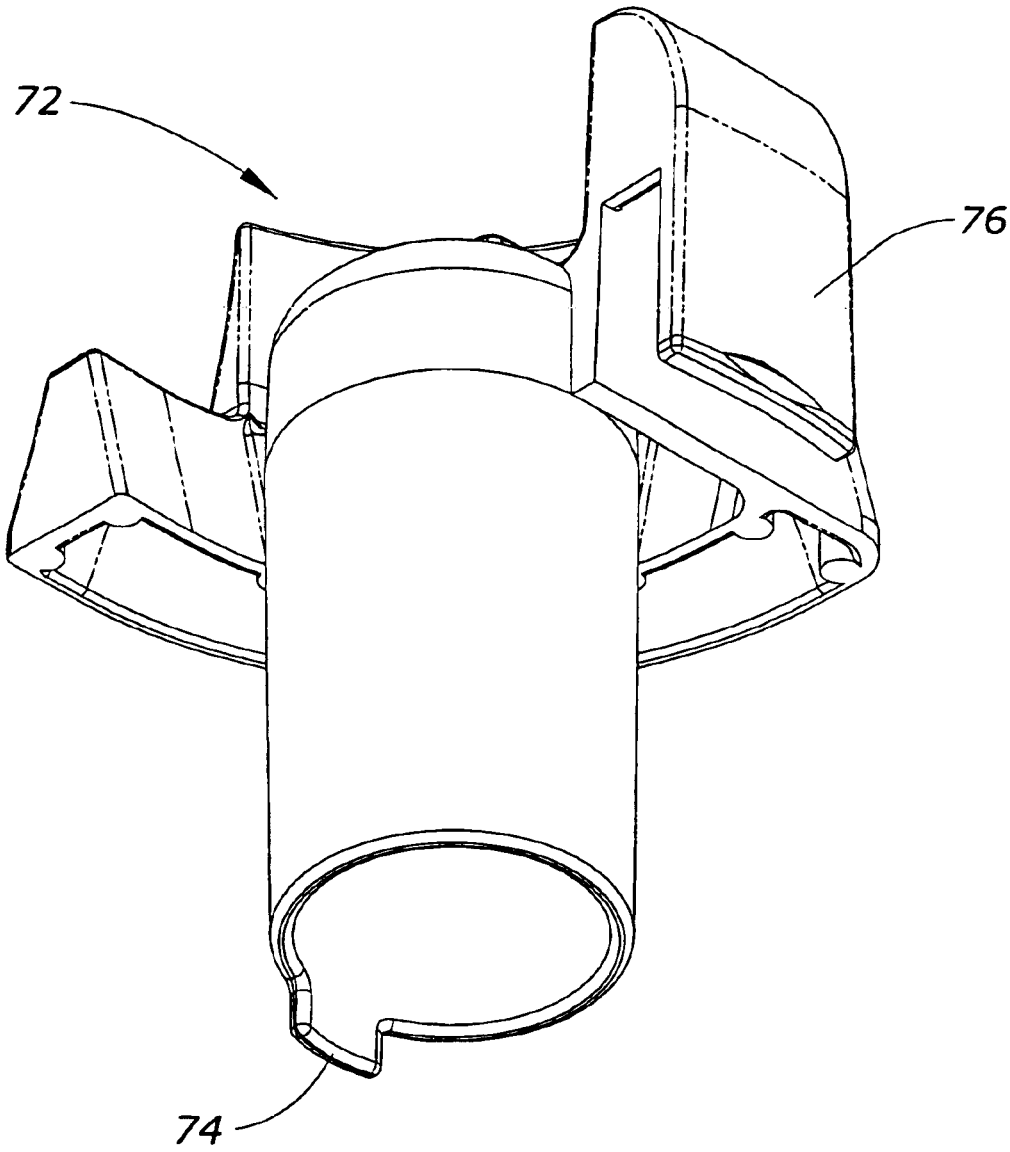
FIG. 4 is a perspective view of the siphon cap for the liquid detergent cup according to the present invention.
Figure 5:
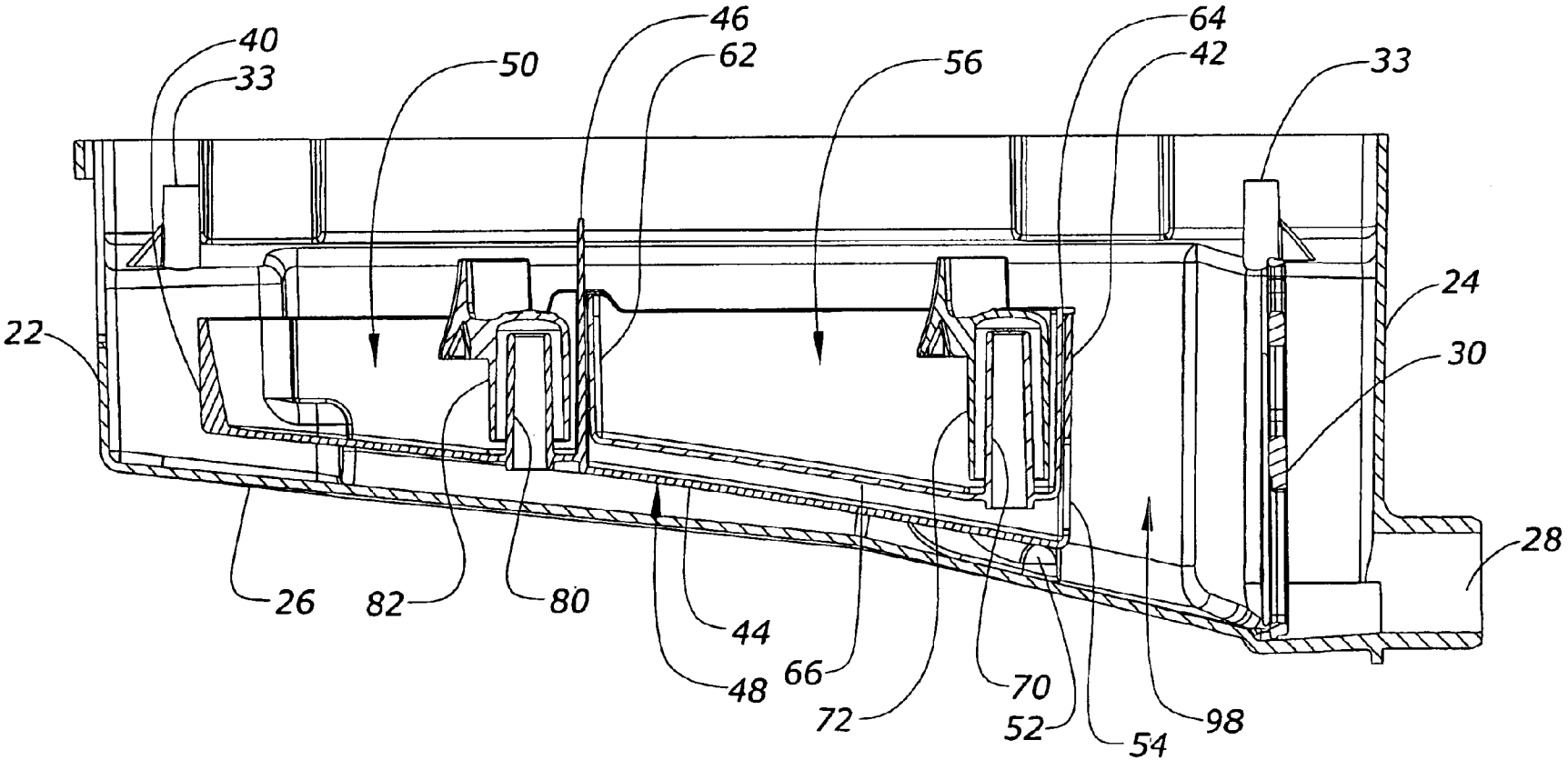
FIG. 5 is a sectional view taken along lines 5—5 of FIG. 2.

The improved detergent dispenser 10 of the present invention is shown mounted in a washing machine 12 in FIG. 3. A lid 14 normally covers the dispenser 10, and is movable between a closed and open position. The washing machine 12 is shown to be a front-loading machine, but it is understood that the dispenser can also be used on a top-loading machine (not shown). The components and operation of the washing machine 12 are conventional, and thus will not be described in detail.

The detergent dispenser 10 of the present invention includes a base 16, with a front wall 18, back wall 20, opposite end walls 22, 24 and a bottom wall 26. An outlet opening or drain 28 is provided in end wall 24. The bottom wall 26 slopes downwardly from the end wall 22 towards the drain 28, such that liquids will flow by gravity toward the drain 28. A grate 30 is removably mounted within guide tracks 32 adjacent the drain 28. The grate 30 catches foreign objects or other large particles and precludes the passage of such material into the drain 28. The base 16 includes bosses 33 for mounting the base 16 to the top panel 13 of the washing machine, as shown in FIG. 3.

An enlarged tray 34 is adapted to set into the base 16. The tray 34 includes a back wall 36, a front wall 38, opposite end walls 40, 42, and a bottom wall or floor 44. An upright dividing wall 46 divides the tray 34 into a powder detergent cup 48 and a conditioner or fabric softener cup 50. The tray 34 rests upon shoulders 52 on the bottom wall 26 of the base 16, such that the bottom wall 44 of the tray 34 is spaced above the bottom wall 26 of the base 16.

While the powder cup 48 and softener cup 50 are shown to be integrally formed, it is understood that the cups 48, 50 could be separate from one another and separately set or positioned within the base 16.

The powder detergent cup 48 includes an outlet opening 54 in the end wall 42 adjacent the back wall 36. The bottom wall 44 slopes downwardly from front to back and end to end toward the outlet opening 54, such that powder detergent contained within the cup 48 can be flushed out the opening 54.

A liquid detergent cup 56 mounts on the powder detergent cup 48. The liquid cup 56 includes a back wall 58, a front wall 60, opposite end walls 62, 64, and a bottom wall or floor 66. A lip 68 is provided on the back wall 58, front wall 60, and end wall 64. The lip 68 engages the walls 36, 38, 42 of the tray 34 to support the liquid detergent cup 56 within the powder detergent cup 48. The liquid cup 56 is shallower than the powder cup 48, such that the bottom wall 66 of the liquid cup 56 is spaced above the bottom wall 44 of the powder cup 48.

Figure 1:
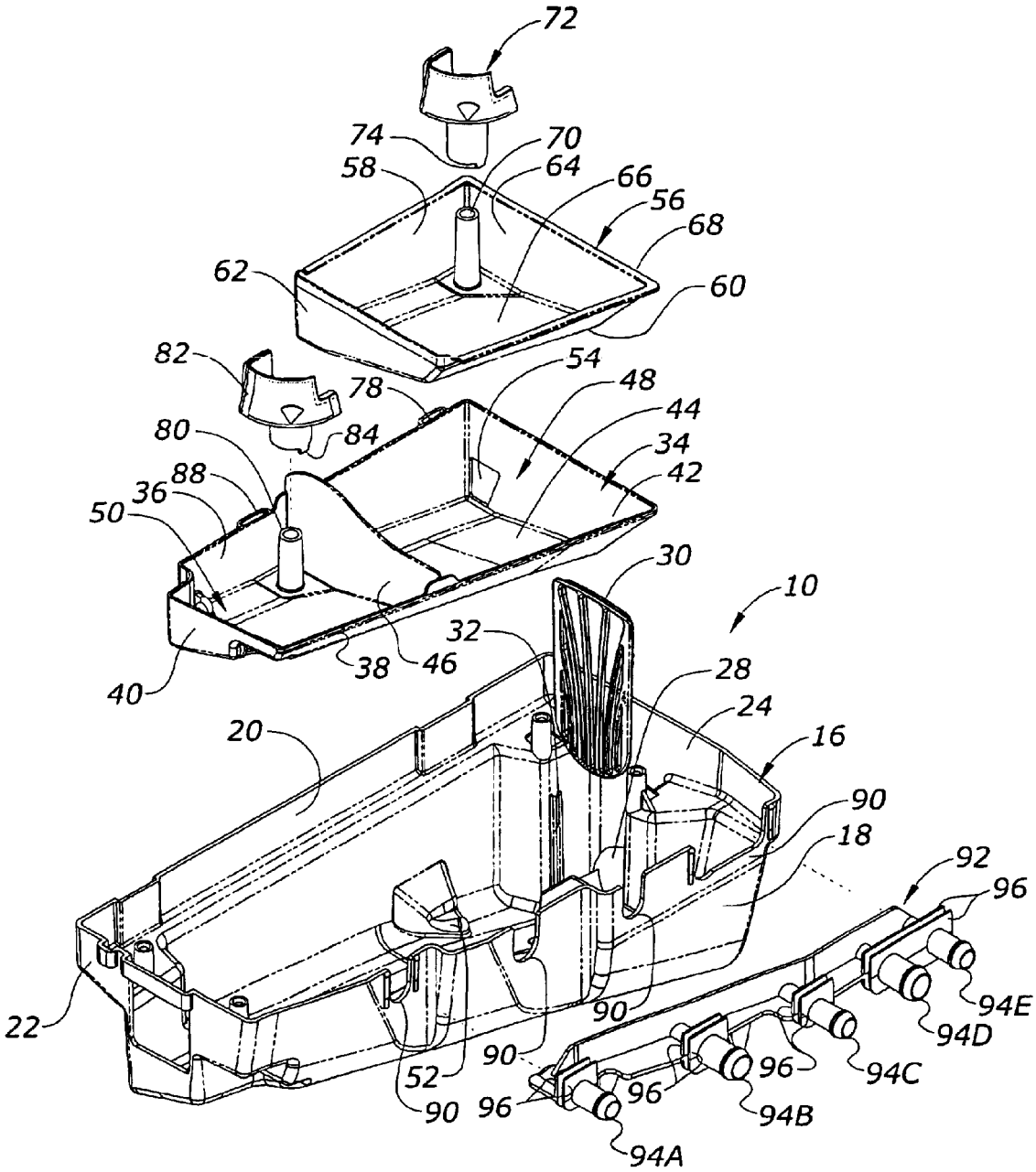
FIG. 1 is an exploded perspective view of the detergent dispenser of the present invention.
Figure 2:
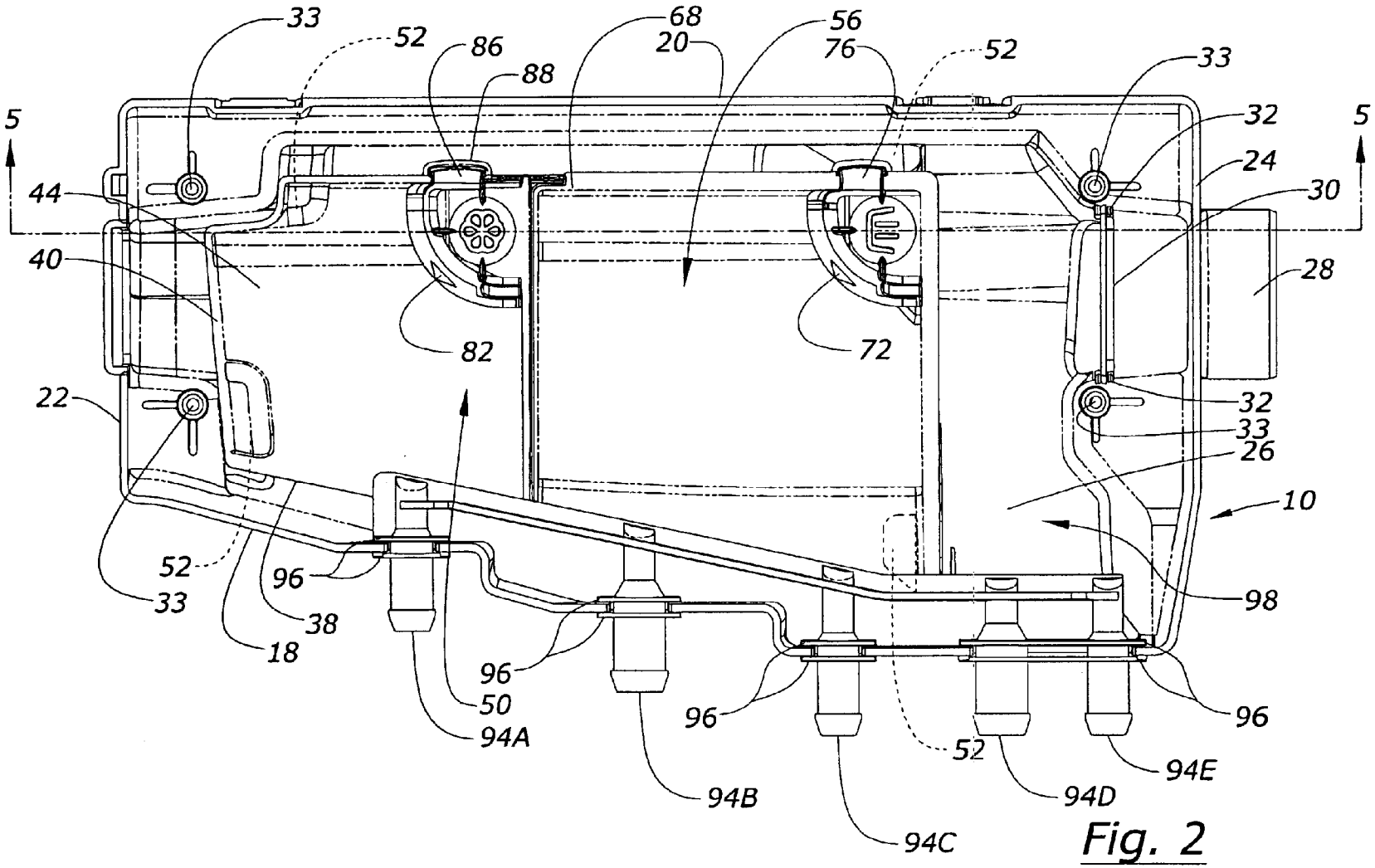
FIG. 2 is a top plan view of the detergent dispenser of the present invention.

A hollow siphon tube 70 extends upwardly from the rear corner of the liquid cup 56 adjacent the back wall 58 and end wall 64. The bottom wall 66 slopes downwardly from end to end and front to back towards the siphon tube 70. A siphon cap 72 fits over the siphon tube 70. The siphon cap 72 has an inside diameter which is greater than the outside diameter of the siphon tube 70. The lower end of the siphon cap 72 includes a leg 74 which spaces the lower end of the cap 72 above the bottom wall 66 of the liquid cup 56. An arm 76 extends upwardly from the cap 72 and then downwardly over the upper edge of the back wall 58 and into a slot 78 (FIGS. 1 and 2) formed on the back wall 36 of the powder cup 48, so as to retain the siphon cap 72 in position over the siphon tube 70. The siphon tube 70 and cap 72 function in a conventional manner so as to siphon liquid detergent upwardly in the space between the cap 72 and the tube 70 and then downwardly through the tube. The tube 70 discharges into the powder cup 48, wherein the liquid detergent flows by gravity out the opening 54, and then into the bottom 26 of the base 16 for drainage out the drain opening 28.

It is further understood that powder detergent cup 48 can be molded integrally with dispenser base 16 while still maintaining the prewash compartment 98. The liquid detergent cup 56 would then be selectively mounted within the integral powder detergent area when it is desired to use liquid detergent.

The fabric softener cup 50 of tray 34 includes a siphon tube 80, similar to tube 70, though shorter in height. A siphon cap 82 is positioned over the siphon tube 80, and has a similar structure to cap 72. The cap 82 includes a leg 84 to space the bottom of the cap 82 above the bottom wall 44 of the softener cup 50, and an arm 86 extending over the back wall 36 and into a slot 88 (FIGS. 1 and 2) on the softener cup 50 so as to retain the cap 82 in position. The bottom wall 44 flows from front to back and end to end toward the siphon tube 80 of the fabric softener cup 50. The siphon tube 80 and siphon cap 82 function conventionally to siphon a liquid fabric softener upwardly in the space between the cap 82 and the tube 80, and downwardly through the center of the tube 80 for discharge into the base 16, then flowing by gravity along the bottom wall 26 and out the drain 28 of the base 16.

The front wall 18 of the base 16 includes a plurality of slots or recesses 90 adapted to receive a water diverter 92. The water diverter 92 has a plurality of water inlet tubes 94A, B, C, D, E, each of which are adapted to be connected to a water hose or line (not shown). Each tube 94 includes a radially extending pair of flanges 96 having a space therebetween slightly greater than the thickness of the front wall 18 of the base 16. Thus, the water diverter 92 is adapted to slide onto the front wall 18 of the base 16, with the tubes 94 received in the recesses 90, and with the portion of the front wall 18 defining the edges of the recesses 90 extending between the respective flanges 96 of the water diverter 92. The end of each water inlet tube 94 extending into the base 16 includes an opening through which water is ejected into the dispenser 10 to flush out the detergent or fabric softener.

More particularly, the water inlet tube 94A directs water into the softener cup 50. The water inlet tubes 94B and C direct water into the powder detergent cup 48, or the liquid detergent cup 56. The water inlet tubes 94D and E introduce water into the base 16 of the dispenser 10 for flushing the prewash powder or liquid detergent out the drain 28. Dual inlet tubes 94B, C and 94D, E are provided for the detergent cup 48 and the prewash compartment 98 to assure sufficient volume of water to flush the detergent out of the cup or compartment. Also, the dual inlet tubes 94B, C and 94D, E are preferably hooked to separate hot and cold water lines. Tubes 94B and D have a larger diameter than tubes 94C and E to simplify assembly and avoid confusion as to which water line connects to which tube.

From the foregoing, it can be seen that the dispenser 10 of the present invention allows a user to selectively choose powder or liquid detergent for the prewash cycle, as well as for the main wash cycle of the washing machine 12. Either liquid or powder detergent can be loaded into the open area or prewash compartment 98 adjacent the end wall 24 of the base 16. If the liquid detergent cup 56 is mounted in the powder detergent cup 48, then the user loads liquid detergent into the cup 56. With the cup 56 removed, the user loads powder detergent into the powder cup 48. Fabric softener is loadable into the softener cup 50. At the appropriate time in a cycle of the washing machine 12, water is introduced through the appropriate inlet tubes 94A–E to flush out the detergent or fabric softener for drainage through the drain 28 and into the tub of the washing machine 12.

From the foregoing, it can be seen that the present invention accomplishes at least all of the stated objectives.

The invention has been shown and described above with the preferred embodiments, and it is understood that many modifications, substitutions, and additions may be made which are within the intended spirit and scope of the invention.

What is claimed is:

1. An improved detergent dispenser for a clothes washing machine having a tub for holding clothes to be washed, comprising:

a base mounted in the washing machine;

a first detergent cup in the base to hold and dispense a powder detergent;

a second detergent cup having a bottom wall removably mounted in the first cup to hold and dispense a liquid detergent;

a water inlet above the bottom wall of the second detergent cut to flush detergent from the first and second cups with water.

2. The dispenser of claim 1 wherein the second cup is selectively installed in and removed from the first cup by a user of the machine.

3. The dispenser of claim 2 wherein the cups dispense the detergent into the base and the base has a drain for directing the detergent into the tub of the machine.

4. The dispenser of claim 3 further comprising a grate removably installed over the drain.

5. The dispenser of claim 1 wherein the first cup includes an outlet opening for directing detergent into the tub.

6. The dispenser of claim 5 wherein the second cup includes a siphon for directing the liquid detergent into the first cup for passage through the outlet opening and then into the tub.

7. The dispenser of claim 1 wherein the second cup is nested within the first cup.

8. The dispenser of claim 1 wherein the first and second cups each have a floor, with the floor of the second cup being spaced above the floor of the first cup.

9. The dispenser of claim 1 wherein the base has a bottom and the first cup has a floor spaced above the bottom of the base.

10. The dispenser of claim 9 wherein the base has shoulders to support the floor of the first cup in spaced relation to the bottom of the base.

11. The dispenser of claim 1 further comprising a third cup to hold and dispense a fabric softener.

12. The dispenser of claim 11 wherein the third cup is formed integrally with the first cup.

13. The dispenser of claim 11 wherein the third cup includes a siphon to direct the fabric softener to the tub.

14. The dispenser of claim 11 wherein the base has a bottom and the third cup has a floor spaced above the bottom of the base.

15. The dispenser of claim 14 wherein the base includes shoulders to support the third cup above the bottom of the base.

16. The dispenser of claim 1 wherein the first cup is smaller than the base to define an area for adding pre-wash detergent to the base for dispensement into the tub.

17. The dispenser of claim 1 wherein the first cup is removably mounted in the base.

18. The dispenser of claim 1 wherein the first and second cups each have a floor and sidewalls, and the second cup has a lip on the walls to support the second cup on the walls of the first cup.

19. The dispenser of claim 18 wherein the second cup is shallower than the first cup, such that the floor of the second cup is spaced from the floor the first cup.

20. An improved clothes washing machine having a tub for holding clothes to be washed, the improvement comprising:

a dispenser having a powder detergent cup, a liquid detergent cup such that a user can choose to use either powder or liquid detergent for a wash cycle of the machine; and a fabric softener cup for adding fabric softener to the tub;

the liquid detergent cup being removably mounted in the powder detergent cup;

a siphon in the liquid detergent cup;

a water inlet independent of the siphon and in communication with the siphon to flush detergent from the first and second cups with water.

21. The improved washing machine of claim 20 wherein the liquid detergent cup is nested within the powder detergent cup.

22. The improved washing machine of claim 20 wherein the dispenser has a portion for receiving a liquid or powder detergent for a prewash cycle of the machine.

23. The improved washing machine of claim 20 wherein the dispenser includes a drain for directing liquid and powder detergent to the tub.

24. The improved washing machine of claim 20 wherein the powder detergent cup includes an outlet opening and the liquid detergent cup siphon is in communication with the outlet opening.

25. The improved washing machine of claim 20 wherein the cups are removable.

26. The improved washing machine of claim 20 wherein the dispenser includes a base, and the powder detergent cup is supported in the base.

27. The improved washing machine of claim 26 wherein the liquid detergent cup empties into the powder cup, which in turn empties into the base, which has a drain communicating with the tub.

28. The improved washing machine of claim 26 wherein the base further defines a prewash detergent compartment.

* * * * *